US006681944B1

(12) United States Patent
Youssef et al.

(10) Patent No.: US 6,681,944 B1
(45) Date of Patent: Jan. 27, 2004

(54) BREAST SIMULATING NURSING SYSTEM

(76) Inventors: Nabil Youssef, 210 Bartholdi Ave. Fl 1, Jersey City, NJ (US) 07305-1806; Caridad Salicrup-Youssef, 210 Bartholdi Ave. Fl 1, Jersey City, NJ (US) 07305-1806

( * ) Notice: Subject to any disclaimer, the term of this patent is extended or adjusted under 35 U.S.C. 154(b) by 0 days.

(21) Appl. No.: 10/142,482

(22) Filed: May 10, 2002

(51) Int. Cl.[7] ..... A61J 9/00; A61J 9/08
(52) U.S. Cl. ..... 215/11.1; 215/11.6
(58) Field of Search ..... 215/11.1, 11.6, 215/12.1, 13.1

(56) References Cited

U.S. PATENT DOCUMENTS

| | | | | | |
|---|---|---|---|---|---|
| 1,985 | A | * | 2/1841 | Windship | 215/11.1 X |
| 78,881 | A | * | 6/1868 | Libbey | 215/11.1 |
| 1,182,042 | A | * | 5/1916 | Rubin | 215/11.6 |
| 2,150,835 | A | * | 3/1939 | Kazimirow | 215/11.6 |
| 2,311,397 | A | * | 2/1943 | Kazimirow | 215/11.6 |
| 3,112,837 | A | | 12/1963 | Manoyian | |
| D264,993 | S | | 6/1982 | Kestenberg | |
| 4,898,290 | A | * | 2/1990 | Cueto | 215/11.1 |
| 4,969,564 | A | * | 11/1990 | Cohen et al. | 215/11.6 X |
| 5,105,956 | A | * | 4/1992 | Tarng-Lin | 215/11.1 |
| 5,436,429 | A | | 7/1995 | Cline | |
| 5,544,766 | A | * | 8/1996 | Dunn et al. | 215/11.1 |
| 5,653,732 | A | | 8/1997 | Sheehy | |
| 5,673,806 | A | | 10/1997 | Busnel | |
| 5,993,479 | A | | 11/1999 | Prentiss | |
| 6,000,565 | A | * | 12/1999 | Ibeagwa | 215/11.6 |
| 6,041,950 | A | * | 3/2000 | Soehnlein | 215/11.1 |
| 6,209,736 | B1 | * | 4/2001 | Chen et al. | 215/11.1 X |

FOREIGN PATENT DOCUMENTS

| | | | | |
|---|---|---|---|---|
| FR | 2600885 | * | 1/1988 | 215/11.1 |
| GB | 2265315 | * | 9/1993 | 215/11.6 |

* cited by examiner

*Primary Examiner*—Sue A. Weaver

(57) ABSTRACT

A breast simulating nursing system for providing a user with a baby feeding accessory that could be used to simulate natural breast feeding. The breast simulating nursing system includes a main body portion that has a first and a second end. The main body portion has a longitudinal axis. The main body portion has a bore that extends therethrough. The bore is positioned such that a longitudinal axis of the bore is collinear with the longitudinal axis of the main body portion. The main body portion simulates a breast. A cover member is coupled to a portion of an exterior surface of the main body portion. The cover member simulates the skin of a breast. A bottle assembly is positionable substantially within the bore of main body portion. The bottle assembly has a first end that protrudes through the first end of the main body portion.

10 Claims, 4 Drawing Sheets

BREAST SIMULATING NURSING SYSTEM

BACKGROUND OF THE INVENTION

1. Field of the Invention

The present invention relates to nursing apparatuses and more particularly pertains to a new breast simulating nursing system for providing a user with a baby feeding accessory that could be used to simulate breast feeding to provide similar benefits for bottle-fed babies and could also help ease the process of transferring a breast-fed infant to the bottle.

2. Description of the Prior Art

The use of nursing apparatuses is known in the prior art. U.S. Pat. No. 3,112,837 describes a disposable plastic bottle for nursing an infant. Another type of nursing apparatus is U.S. Pat. No. 5,653,732 describing a natural formed nipple for a baby bottle. U.S. Pat. No. 5,993,479 describes an infant feeding container which attempts to imitate a human breast in form and function. U.S. Pat. No. 5,673,806 describes a teat for a baby's bottle and a bottle fitted with such a teat. U.S. Pat. No. 5,436,429 describes a flexible electric heating pad for wrapping around a baby bottle powered by a vehicle cigarette lighter plug. U.S. Pat. No. Des. 264,993 describes an ornamental design for a simulated breast nurser.

While these devices fulfill their respective, particular objectives and requirements, the need remains for a system that is superior in function to prior systems.

SUMMARY OF THE INVENTION

The present invention meets the needs presented above by including an insulation layer to keep the milk warm. The present invention also features a replaceable nipple that is featured in different sizes. The areola portion of the invention has a realistic, sponge-like texture and is also malleable.

Another object of the present invention is to provide a new breast simulating nursing system that would help mothers and fathers bond with their children during the early stages of a child's life.

Still another object of the present invention is to provide a new breast simulating nursing system that could ensure that infants obtain the important psychological benefits that experts say can be derived from breast feeding.

To this end, the present invention generally comprises a main body portion that has a first and a second end. The main body portion has a longitudinal axis. The main body portion has a bore that extends therethrough. The bore is positioned such that a longitudinal axis of the bore is collinear with the longitudinal axis of the main body portion. The main body portion simulates a breast. A cover member is coupled to a portion of an exterior surface of the main body portion. The cover member simulates the skin of a breast. A bottle assembly is positionable substantially within the bore of main body portion. The bottle assembly has a first end that protrudes through the first end of the main body portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
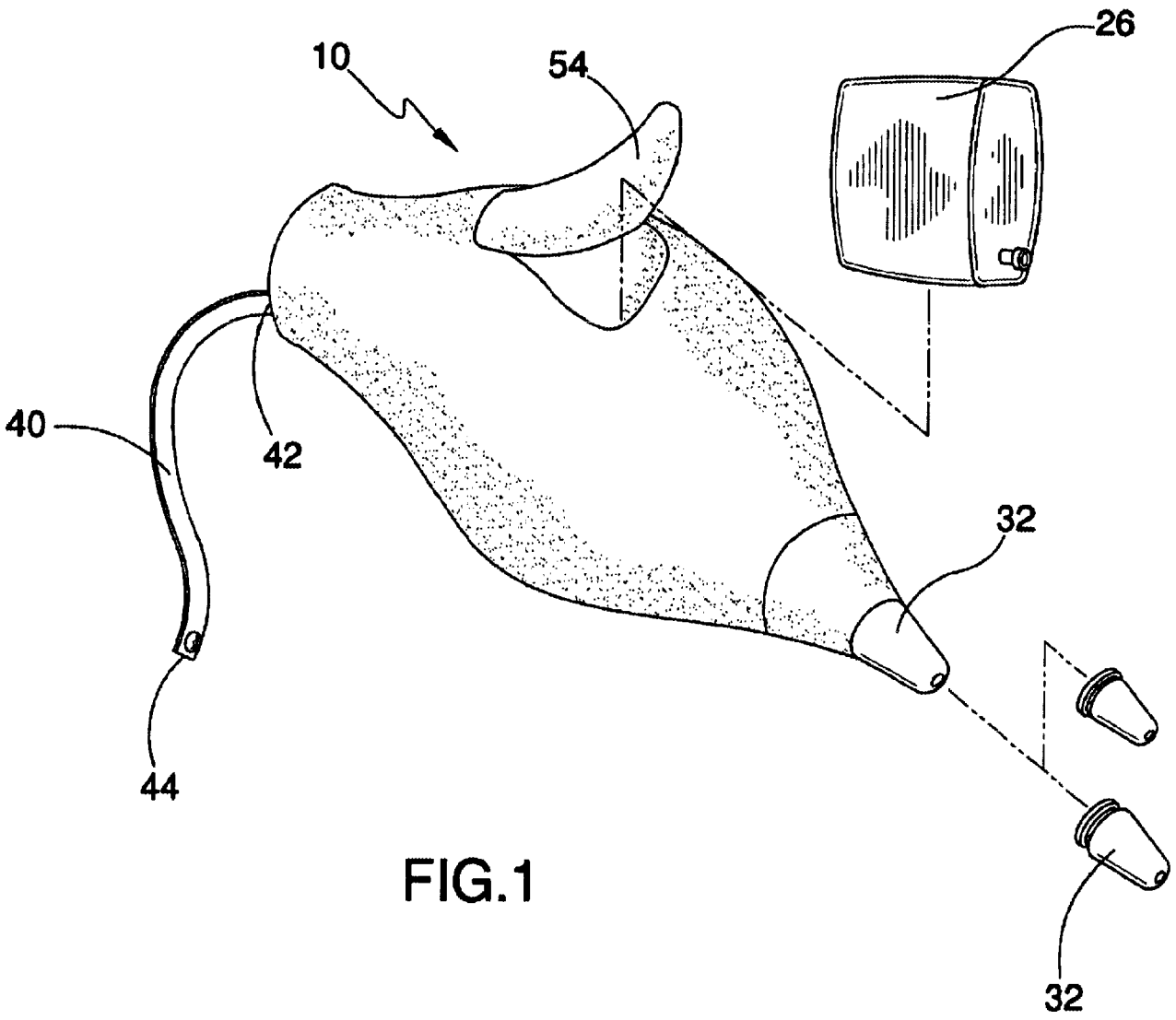
FIG. 1 is a perspective view of a new breast simulating nursing system according to the present invention.
Figure 2:
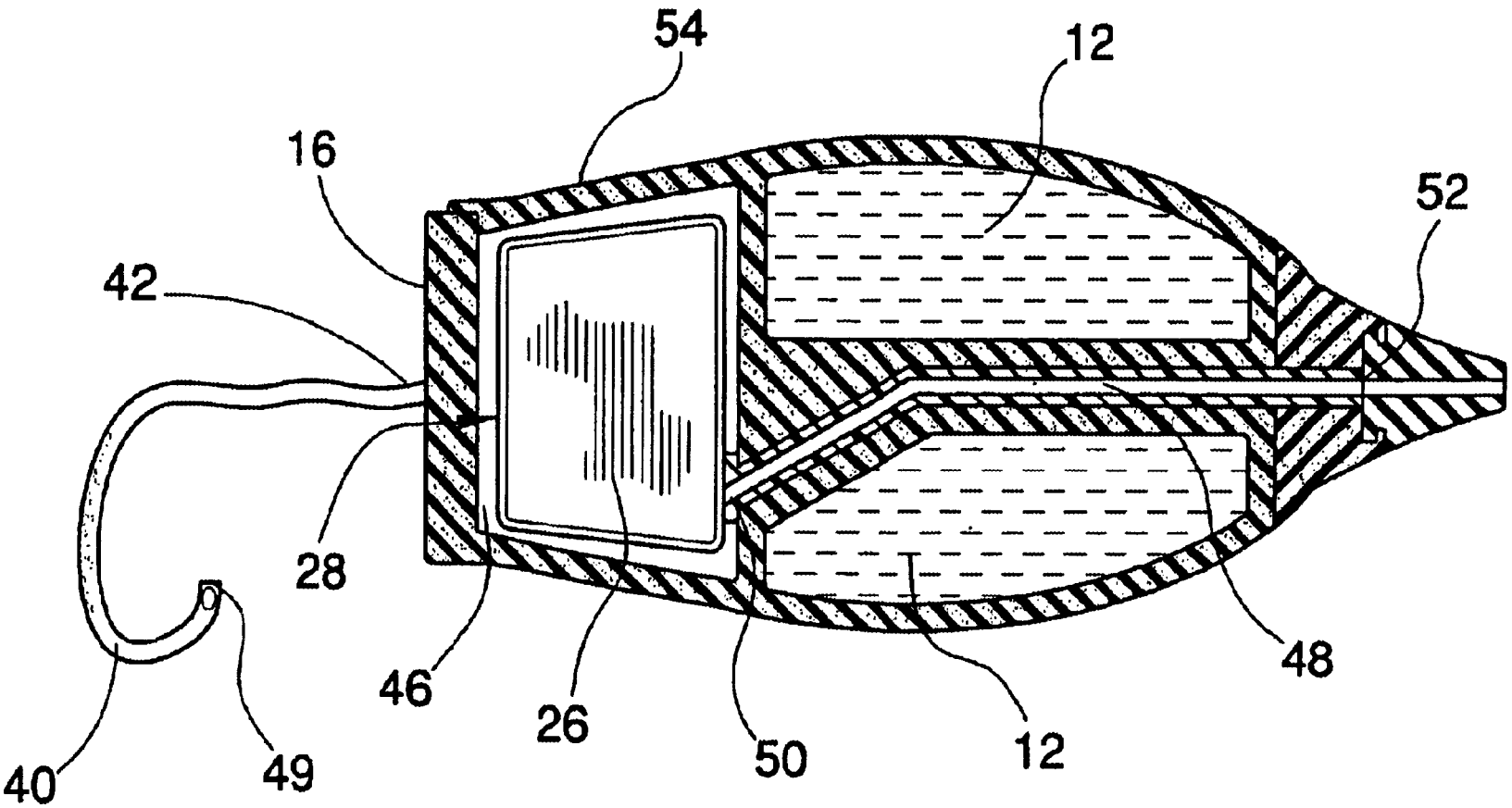
FIG. 2 is a cross-sectional view of the present invention.
Figure 3:
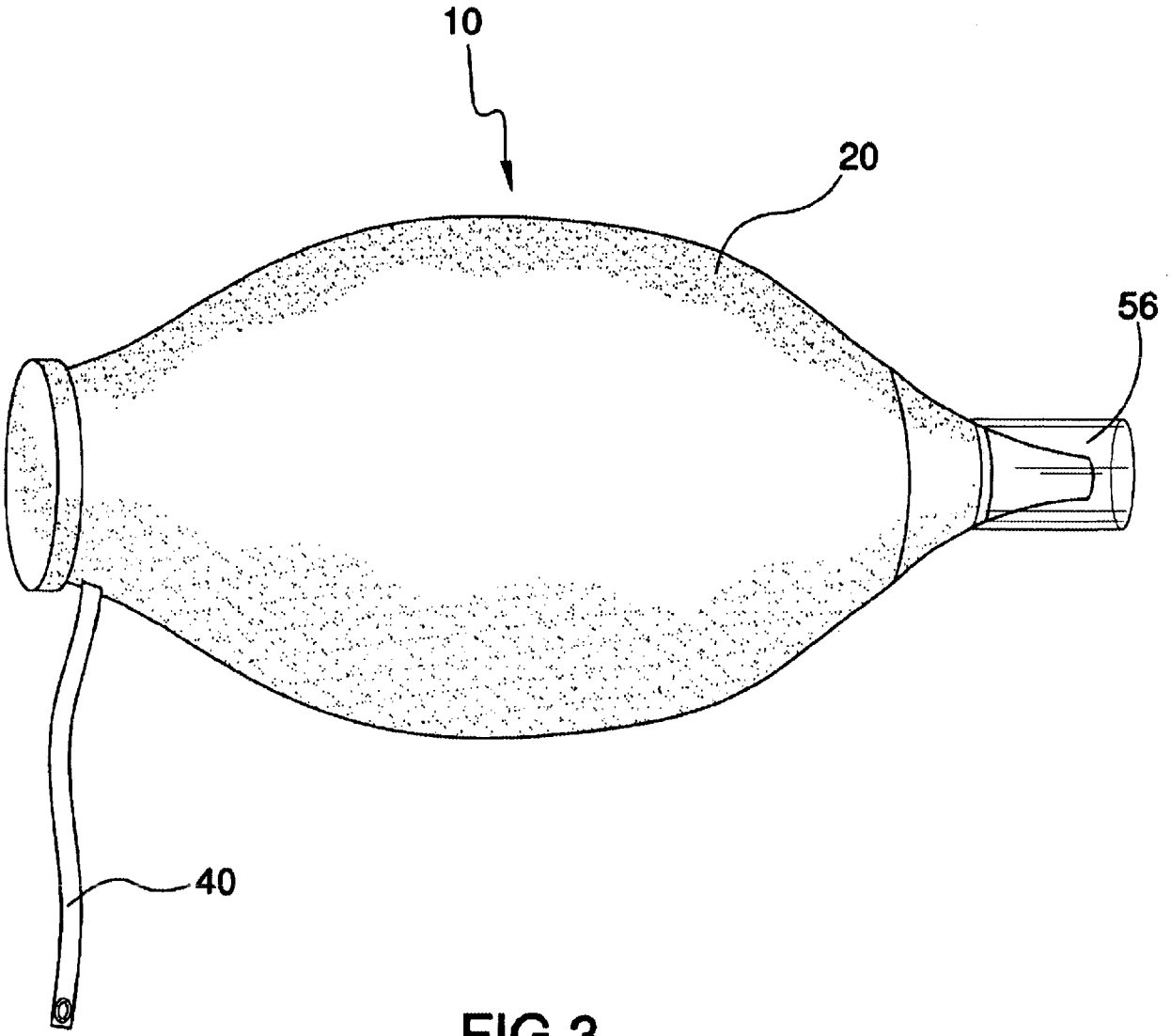
FIG. 3 is a side view of the present invention.
Figure 4:
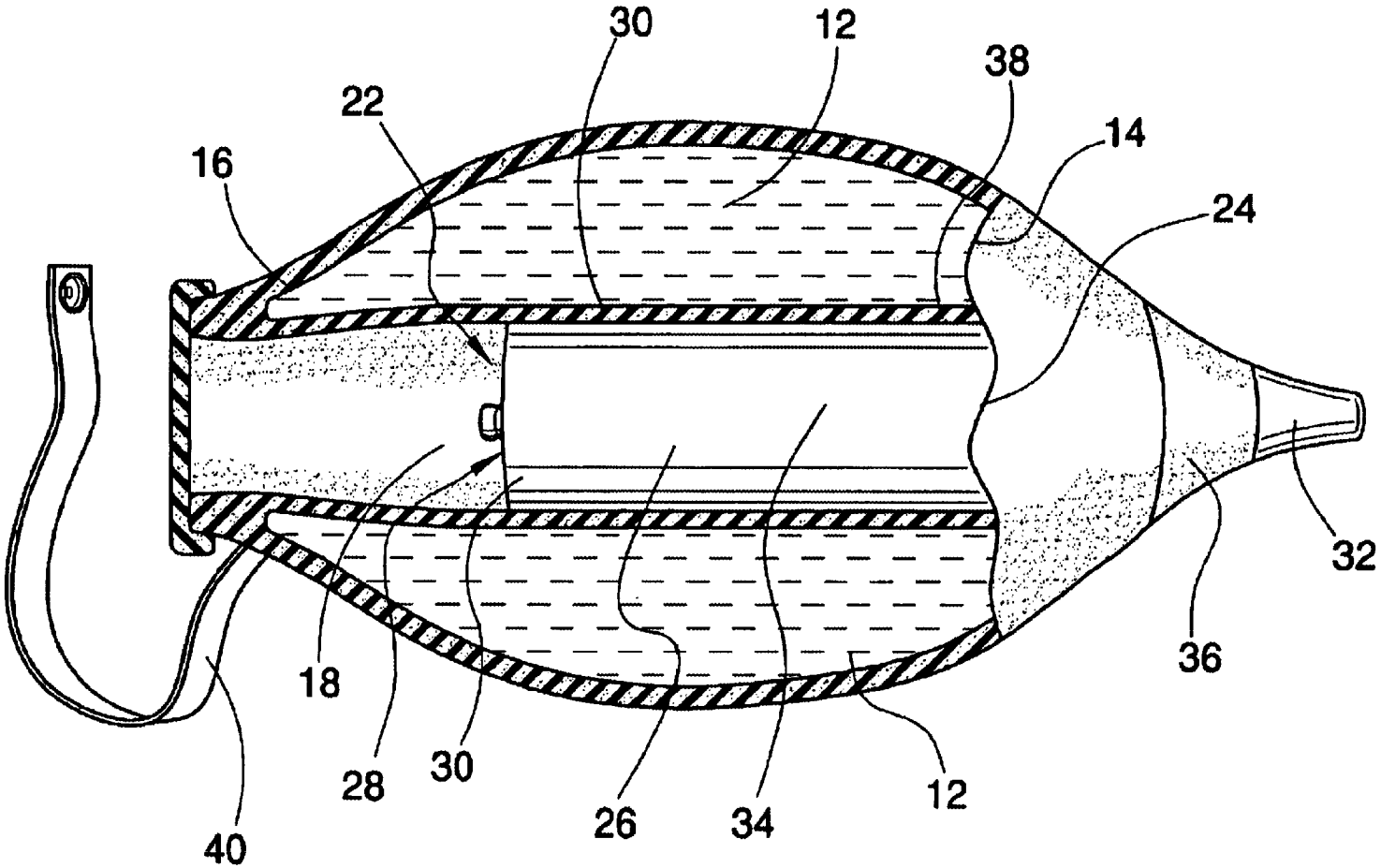
FIG. 4 is a cut-away view of the present invention.

With reference now to the drawings, and in particular to FIGS. 1 through 4 thereof, a new breast simulating nursing system embodying the principles and concepts of the present invention and generally designated by the reference numeral 10 will be described.

As best illustrated in FIGS. 1 through 4, the breast simulating nursing system 10 generally comprises a main body portion 12 that has a first 14 and a second 16 end. The main body portion 12 has a longitudinal axis. The main body portion 12 has a bore 18 that extends therethrough. The bore 18 is positioned such that a longitudinal axis of the bore 18 is collinear with the longitudinal axis of the main body portion 12. The main body portion 12 simulates a breast. A cover member 20 is coupled to a portion of an exterior surface of the main body portion 12. The cover member 20 simulates the skin of a breast. A bottle assembly 22 is positionable substantially within the bore 18 of main body portion 12. The bottle assembly 22 has a first end 24 that protrudes through the first end 14 of the main body portion 12.

A container portion 26 has a bottom wall 28 and a perimeter wall 30 that extend upwardly therefrom. The container portion 26 is designed for holding a liquid. A nipple portion 32 is operationally couplable to the container portion 26. The nipple portion 32 is positionable to extend beyond the first end 14 of the main body portion 12. The nipple portion 32 is in environmental communication with an internal space 34 of the container portion 26. The nipple portion 32 is designed to be suckled by a infant. A sponge portion 36 is applied to a portion of an external surface of the main body portion 12 adjacent to a perimeter edge 38 of the bore 18. The sponge portion 36 simulates an areola.

In an embodiment, the container portion 26, is cylindrical. This cylindrical configuration, while not necessary for the operation of the system 10, provides a easier installation and removal of the container portion 26 with respect to the main body portion 12.

A strap member 40 has a first 42 and second 44 strap end. The first strap end 42 is couplable to the second end 16 of the main body portion 12. The second strap end 44 is couplable to the bottle assembly 22 for facilitating removal of the bottle assembly 22 from the bore 18 after use.

The main body portion 12 has a container chamber 46 that is positioned adjacent of the second end 16 of the main body portion 12. The container chamber 46 is for selectively receiving the container portion 26. A tube member 48 has a distal 50 and a proximal 52 end. The distal end 50 is operationally couplable to the container portion 26. The proximal end 52 is operationally couplable to the nipple portion 32. The tube member 48 facilitates environmental communication between the container portion 26 and the nipple portion 32.

The main body portion 12 further includes a flap member 54 for facilitating access to the container chamber 46 through a perimeter wall of the main body portion 12 and the cover member 20.

Each one of the nipple portions 32 is operationally couplable to the container portion 26. Each one of the plurality of nipple sizes has a unique size relative to each other of the plurality of nipple portions 32.

A cap member 56 is positionable substantially over the nipple portion 32. The cap member 56 inhibiting spillage before use. The cap member 56 protects the nipple portion 32 prior to use.

In an embodiment, the main body portion is comprised of a gel type material. The gel type material may be selected from the group of gel type materials consisting of silicone, non-toxic gels, water cells, and foam. These types of materials provide soft, supple, and squeezable characteristics for the simulated breast nursing system.

In use, a user would utilize the present invention similarly to a conventional nursing system.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A breast simulating nursing system comprising:

a main body portion having a first and a second end, said main body portion having a longitudinal axis, said main body portion having a bore extending therethrough, said bore being positioned such that a longitudinal axis of said bore being collinear with said longitudinal axis of said main body portion, said main body portion simulating a breast;

a cover member coupled to a portion of an exterior surface of said main body portion, said cover member simulating skin of a breast; and a bottle assembly positionable substantially within said bore of main body portion, said bottle assembly having a first end protruding through said first end of said main body portion;

said bottle assembly comprising a container portion, said container portion having a bottom wall and a perimeter wall extending upwardly therefrom, said container portion being adapted for holding a liquid;

said bottle assembly comprising a nipple portion, said nipple portion being operationally couplable to said container portion, said nipple portion being positionable to extend beyond said first end of said main body portion, said nipple portion being in environmental communication with an internal space of said container portion, said nipple portion being adapted for being suckled by a infant;

wherein a sponge portion applied to a portion of an external surface of said main body portion adjacent to a perimeter edge of said bore, said sponge portion simulating an areola; and wherein a strap member having a first and second strap end, said first strap end being couplable to said second end of said main body portion, said second strap end being couplable to said bottle assembly for facilitating removal of said bottle assembly from said bore after use.

2. The system of claim 1, further comprising:

said bore of said main body portion having a container chamber positioned adjacent of said second end of said main body portion, said container chamber being for selectively receiving said container portion; and a tube member having a distal and a proximal end, said distal end being operationally couplable to said container portion, said proximal end being operationally couplable to said nipple portion, said tube member facilitating environmental communication between said container portion and said nipple portion.

3. The system of claim 2, wherein said main body portion further comprises a flap member facilitating access to said container chamber through a perimeter wall of said main body portion and said cover member.

4. The system of claim 1, further comprising a plurality of nipple portions, each one of said nipple portions being operationally couplable to said container portion, each one of said plurality of nipple portions having a unique size relative to each other of said plurality of nipple portions.

5. The system of claim 1, further comprising a cap member positionable substantially over said nipple portion said cap member inhibiting spillage before use, said cap member protecting said nipple portion prior to use.

6. A breast simulating nursing system comprising:

a main body portion having a first and a second end, said main body portion having a longitudinal axis, said main body portion having a bore extending therethrough, said bore being positioned such that a longitudinal axis of said bore being collinear with said longitudinal axis of said main body portion, said main body portion simulating a breast;

a cover member coupled to a portion of an exterior surface of said main body portion, said cover member simulating skin of a breast;

a bottle assembly positionable substantially within said bore of main body portion, said bottle assembly having a first end protruding through said first end of said main body portion;

a sponge portion applied to a portion of an external surface of said main body portion adjacent to a perimeter edge of said bore, said sponge portion simulating an areola.

7. The system of claim 6, wherein said bottle assembly further comprises:

a container portion having a bottom wall and a perimeter wall extending upwardly therefrom, said container portion being substantially cylindrical, said container portion being adapted for holding a liquid; and a nipple portion operationally couplable to said container portion, said nipple portion being positionable to extend beyond said first end of said main body portion, said nipple portion being in environmental communication with an internal space of said container portion, said nipple portion being adapted for being suckled by a infant.

8. The system of claim 6, further comprising a strap member having a first and second strap end, said first strap end being couplable to said second end of said main body portion, said second strap end being couplable to said bottle assembly for facilitating removal of said bottle assembly from said bore after use.

9. A breast simulating nursing system comprising:

a main body portion having a first and a second end, said main body portion having a longitudinal axis, said main body portion having a bore extending therethrough, said bore being positioned such that a longitudinal axis of said bore being collinear with said longitudinal axis of said main body portion, said main body portion simulating a breast;

a cover member coupled to a portion of an exterior surface of said main body portion, said cover member simulating skin of a breast;

a bottle assembly positionable substantially within said bore of main body portion, said bottle assembly having a first, end protruding through said first end of said main body portion;

a strap member having a first and second strap end, said first strap end being couplable to said second end of said main body portion, said second strap end being couplable to said bottle assembly for facilitating removal of said bottle assembly from said bore after use.

10. The system of claim 9, wherein said bottle assembly further comprises:

a container portion having a bottom wall and a perimeter wall extending upwardly therefrom, said container portion being substantially cylindrical, said container portion being adapted for holding a liquid; and a nipple portion operationally couplable to said container portion, said nipple portion being positionable to extend beyond said first end of said main body portion, said nipple portion being in environmental communication with an internal space of said container portion, said nipple portion being adapted for being suckled by a infant.

* * * * *